US007737843B2

(12) United States Patent
Belden, Jr. et al.

(10) Patent No.: US 7,737,843 B2
(45) **Date of Patent: *Jun. 15, 2010**

(54) PROGRAMMABLE ALARM MODULE AND SYSTEM FOR PROTECTING MERCHANDISE

(75) Inventors: Dennis D. Belden, Jr., Canton, OH (US); Ronald M. Marsilio, Lake Wiley, SC (US); Ian R. Scott, Duluth, GA (US)

(73) Assignee: Invue Security Products Inc., Charlotte, NC (US)

( * ) Notice: Subject to any disclaimer, the term of this patent is extended or adjusted under 35 U.S.C. 154(b) by 506 days.

This patent is subject to a terminal disclaimer.

(21) Appl. No.: 11/638,727

(22) Filed: Dec. 14, 2006

(65) Prior Publication Data

US 2007/0146134 A1 Jun. 28, 2007

Related U.S. Application Data

(60) Provisional application No. 60/753,631, filed on Dec. 23, 2005.

(51) Int. Cl.
*G08B 13/12* (2006.01)

(52) U.S. Cl. ..... 340/568.2; 340/691.1; 340/693.5; 340/815.45

(58) Field of Classification Search ..... 340/568.2, 340/568.1, 568.8, 572.1, 693.5, 691.1, 815.45, 340/572.8, 572.9; 70/277, 278.2
See application file for complete search history.

(56) References Cited

U.S. PATENT DOCUMENTS

| | | | |
|---|---|---|---|
| 3,493,955 | A | 2/1970 | Minasy |
| 4,573,042 | A | 2/1986 | Boyd et al. |
| 4,686,513 | A | 8/1987 | Farrar et al. |
| 4,800,369 | A | 1/1989 | Gomi et al. |
| 4,851,815 | A | 7/1989 | Enkelmann |
| 4,853,692 | A | 8/1989 | Wolk et al. |
| 4,980,671 | A | 12/1990 | McCurdy |
| 5,005,125 | A | 4/1991 | Farrar et al. |
| 5,182,543 | A | 1/1993 | Siegel et al. |
| 5,245,317 | A | 9/1993 | Chidley et al. |

(Continued)

FOREIGN PATENT DOCUMENTS

| | | |
|---|---|---|
| JP | 8279082 | 10/1996 |

*Primary Examiner*—Thomas J Mullen
(74) *Attorney, Agent, or Firm*—Christopher C. Dremann, P.C.

(57) ABSTRACT

A security alarm module for attaching to an item of merchandise in a security system for protecting the item of merchandise has a housing, a logic control circuit including a central controller, a wireless interface for communicating with a programmable key containing a security code, and a memory circuit for storing the security code. An attachment device attaches the alarm module to the item of merchandise and a sense loop operatively communicates with the attachment device for sensing when the integrity of the attachment device is compromised. An audio alarm is located within the housing and is actuated when the integrity of the sense loop is compromised. A visual indicator such as an LED, indicates the status of the alarm module. The housing includes a base and a bottom housing member which is spaced from the base to form a sound region. The audio alarm is mounted in the bottom housing member and communicates with the sound region which enhances the sound level of the alarm when actuated. The housing includes a plurality of terminal jacks which are connected to the logic control circuit for connection to one or more attachment devices containing the sense loops which extend from the alarm module to items of merchandise.

20 Claims, 7 Drawing Sheets

U.S. PATENT DOCUMENTS 5,367,289 A 11/1994 Baro et al.
5,570,080 A 10/1996 Inoue et al.
5,589,819 A 12/1996 Takeda
5,610,587 A 3/1997 Fujiuchi et al.
5,640,144 A 6/1997 Russo et al.
5,656,998 A 8/1997 Fujiuchi et al.
5,748,083 A * 5/1998 Rietkerk ..... 340/568.2
5,764,147 A 6/1998 Sasagawa et al.
5,767,773 A 6/1998 Fujiuchi et al.
5,793,290 A 8/1998 Eagleson et al.
5,808,548 A 9/1998 Sasagawa et al.
5,836,002 A * 11/1998 Morstein et al. ..... 340/568.1
5,838,234 A 11/1998 Roulleaux-Robin
5,864,290 A 1/1999 Toyomi et al.
5,955,951 A 9/1999 Wischerop et al.
5,982,283 A 11/1999 Matsudaira et al.
6,020,819 A 2/2000 Fujiuchi et al.
6,037,879 A 3/2000 Tuttle
6,043,744 A 3/2000 Matsudaira
6,104,285 A 8/2000 Stobbe
6,118,367 A 9/2000 Ishii
6,122,704 A * 9/2000 Hass et al. ..... 711/100
6,137,414 A 10/2000 Federman
6,144,299 A 11/2000 Cole
6,255,951 B1 7/2001 De La Huerga
6,304,181 B1 10/2001 Matsudaira
6,346,886 B1 2/2002 De La Huerga
6,420,971 B1 7/2002 Leck et al.
6,433,689 B1 8/2002 Hovind et al.
6,474,117 B2 11/2002 Okuno
6,512,457 B2 1/2003 Irizarry et al.
6,531,961 B2 3/2003 Matsudaira
6,535,130 B2 3/2003 Nguyen et al.
6,961,000 B2 11/2005 Chung
7,002,467 B2 * 2/2006 Deconinck et al. ..... 340/568.2
7,102,509 B1 9/2006 Anders et al.
2002/0024440 A1 2/2002 Okuno
2005/0231365 A1 * 10/2005 Tester et al. ..... 340/568.1
2005/0242962 A1 * 11/2005 Lind et al. ..... 340/568.2
2007/0131005 A1 * 6/2007 Clare ..... 70/256
2007/0194918 A1 * 8/2007 Rabinowitz et al. ..... 340/568.2

* cited by examiner

SDC – Secure Disarming Code
MFG – Manufacturing
SW – Switch
CFG – Configuration
Comm I/F – Communications Interface
EAS – Electronic Article Surveillance
AU – Alarm Unit
PS – Programming Station
EOL – End of Life
INIT – Initialize
NP – Not Programmed
ACT SW – Activation Switch
NON–VOL – Non–Volatile
B&F – Beep and Flash
A&F – Alarming and Flashing
SN – Sense

PROGRAMMABLE ALARM MODULE AND SYSTEM FOR PROTECTING MERCHANDISE

CROSS REFERENCE TO RELATED APPLICATIONS

This application claims priority from U.S. Provisional Application Ser. No. 60/753,631 filed Dec. 23, 2005; the disclosure of which is incorporated herein by reference.

BACKGROUND OF THE INVENTION

1. Technical Field

The invention relates to security devices and systems for protection of merchandise, and in particular, a system based on a smart key that is programmed with a security disarm code (SDC) at a programming station, and more particularly to an alarm module attached to an item of merchandise into which the SDC is programmed by the smart key for subsequent disarming of the alarm module.

2. Background Information

Various retail establishments use numerous types of theft deterrent devices and systems to discourage shoplifters. Many of these systems use various types of alarm modules which are attached to an article to be protected in one manner or another. When the integrity of the module or the item of merchandise protected thereby is compromised in any manner, such as cutting attachment cables which attach the alarm module to the item of merchandise, removing the merchandise from the alarm module or disturbing the alarm module, will cause an audible alarm to be sounded in the module to alert store personnel that the item of merchandise or security device is being tampered with illegally. These alarm modules, as well as the items of merchandise protected thereby, also may contain various electronic article surveillance tags (EAS) which will sound an alarm at a security gate upon approaching or passing through the gate in an unauthorized manner.

These alarm modules usually have some type of key, either mechanical or magnetic, which is used to unlock the module from the protected item of merchandise to enable the merchandise to be taken to a checkout counter, as well as to disarm the audible alarm contained in the alarm module. One problem with such security systems is that these keys will be stolen from the retail establishment and used at the same store or at another store using the same type of alarm modules or security devices, to enable a thief to disarm the alarm module as well as unlock it from the protected merchandise. These keys also are stolen by dishonest employees for subsequent unauthorized use by the employee or sale to a thief for use at the same or other stores which use the same alarm modules controlled by the key.

It is extremely difficult to prevent the theft of these alarm module keys by dishonest employees or even by a thief within the retail establishment due to the number of keys that must be available and used by the various clerks in the various departments of the store to facilitate the use of the numerous alarm modules that are needed to protect the numerous items of merchandise.

Thus, the need exists for a security system and in particular for an alarm module used therein, which is attached to various items of merchandise, which will prevent or deter a thief or dishonest employee from using the key that is used to disarm the alarm module in an unauthorized manner, as well as preventing use of the key on similar types of alarm modules at other retail establishments including the store from which the key was stolen.

BRIEF SUMMARY OF THE INVENTION

One aspect of the present invention is to provide a security system for protecting items of merchandise, and in particular an alarm module used therein, which system uses a programmable smart key for disarming an alarm module. The smart key is programmed with a unique security disarm code (SDC) by a programming station and then used to program the SDC into the alarm module. The SDC is unique to a particular retail establishment thereby preventing the key from being used on alarm modules at a different store than that from which the key is stolen.

A further aspect of the present invention is to use the SDC which is programmed into the smart key to program each of the individual alarm modules with the same SDC when the alarm modules are first activated, which enables the SDC to remain with the alarm modules throughout their use in a particular retail establishment.

Still another aspect of the present invention is to provide wireless communication between the various elements of the system, namely for transmitting the SDC between the smart key, programming station and alarm module based upon IR, RF or similar wireless transmission.

Another aspect of invention is to enable the alarm module to actuate an alarm if a key is attempted to be used to disarm the alarm module containing a wrong SDC.

Another feature of the invention is to provide for a visual and audible indication of the status of the alarm module, such as whether the alarm module is armed or disarmed, whether the alarm module is operational and whether the integrity of the alarm module including various sense loops connected thereto, is being compromised and whether a wrong key is attached and attempted to be utilized to disarm the alarm module.

Another aspect of the invention is to provide the alarm module with a plurality of attachment ports or jacks for connecting attachment cables to the alarm module and to items of merchandise to be protected thereby, which attachment cables contain sense loops which sound an alarm if the integrity of the loop is compromised by a thief.

A further feature of the invention is to form the alarm module of plastic components, namely, a housing having base which can be secured to a supporting surface by mechanical fasteners preventing its removal therefrom, a bottom housing member on which is mounted a printed circuit board containing the logic control circuitry and internal power supply, a top housing member which is mounted on the bottom housing member and forms an internal chamber in which the control logic circuit board and other components are located, and a top housing cover which is secured to the top and bottom housing members. The housing cover is provided with a smart key communication port for aligning the smart key with the internal wireless communication system of the logic control circuit and is provided with a simulated speaker grill to advise a potential thief that the alarm module contains an audible alarm.

Another aspect of the invention is to space the top and bottom housing members from the base to provide a sound transmission space therebetween whereby a piezo audible alarm mounted in the bottom housing member and communicating directly with this space provides an increased dB audible output thereby increasing the effectiveness of the audible alarm system.

Still another aspect of the invention is to provide the alarm module with an electronic article surveillance (EAS) tag which would sound an alarm at an exit of a retail store if the alarm module is passed through the security gate in an unauthorized manner.

A further aspect of the invention is the incorporation of an operational lifetime timer into the logic control circuit which is preset for a specific time period, for example five years, to insure that the self-contained battery has sufficient charge for operating the alarm module, and that a counter records the amount of time that the alarm is activated which causes substantial power drain on the battery. This alarm time automatically reduces the lifetime period in the lifetime timer by a predetermined amount. The lifetime counter automatically disables the alarm module at the end of the lifetime period.

Still another feature of the invention is that shortly before the lifetime period is reached the logic control circuit will activate an end-of-life signal, which will alert store personnel that after a predetermined time period, for example one week, the alarm module will be permanently inactivated requiring replacement in order to prevent the alarm module from becoming inoperative without notifying store personnel of this condition due to low battery power.

These features are obtained by the alarm module of the present invention the general nature of which may be stated as including a housing; a logic control circuit including a central controller, a wireless interface for communicating with a key containing a SDC, and a memory circuit for storing the SDC; an attachment device for attaching the alarm module to an item of merchandise; a sense loop operatively communicating with the attachment device for sensing when the integrity of the attachment is compromised; and an audio alarm which is actuated when the integrity of the sense loop is compromised.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
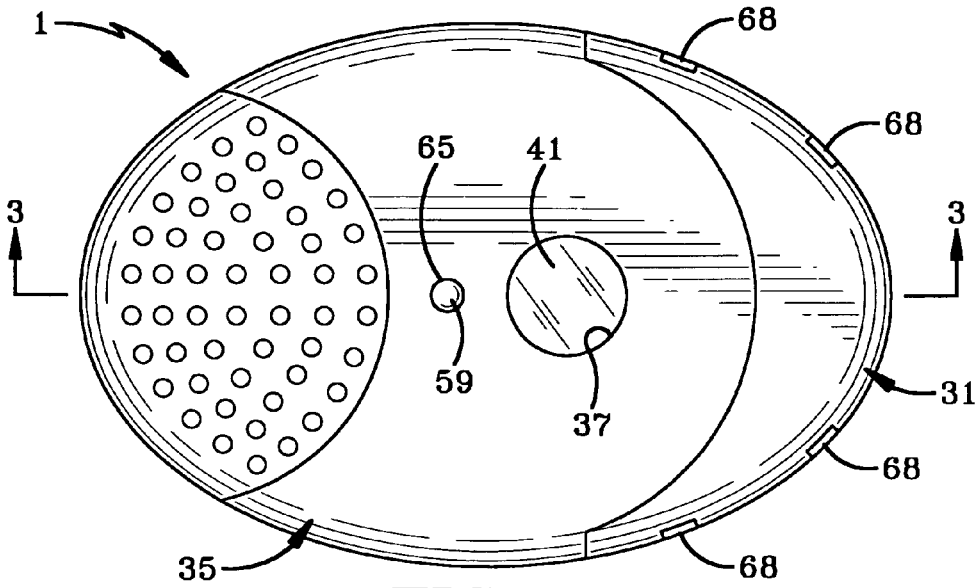
FIG. 1 is a top plan view of the alarm module of the present invention.
Figure 2:
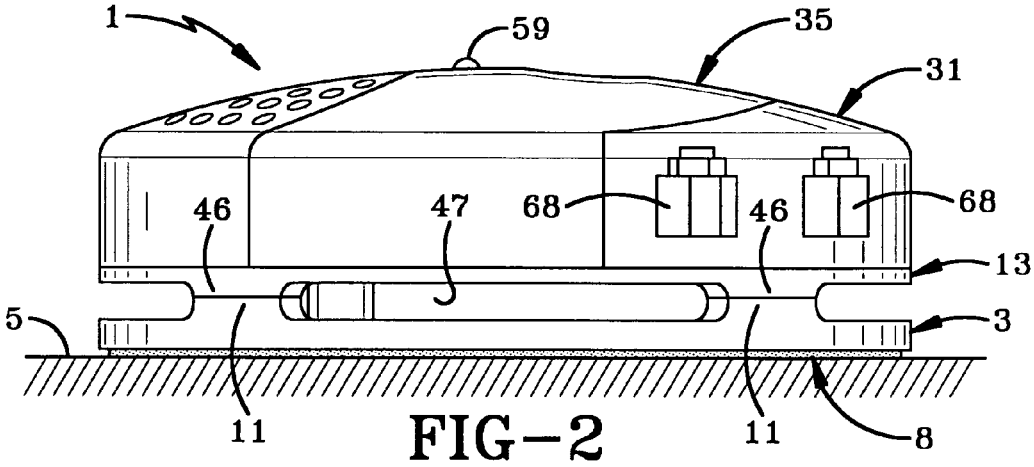
FIG. 2 is a side elevational view of the alarm module of FIG. 1.

The alarm module of the present invention is indicated generally at 1, and is shown particularly in FIGS. 1-4. Alarm module 1 includes as its main components a base 3 which is adapted to be secured to a supporting surface 5 by a plurality of mechanical fasteners or screws 7 which extend through a plurality of holes 9 formed in base 3. A foam pad 8 having one or more layers of a pressure sensitive adhesive secures base 3 to surface 5. Base 3 is formed with a plurality of posts 11 extending upwardly therefrom on which is supported a bottom housing member indicated generally at 13. A printed circuit board, indicated generally at 15, is mounted on a portion of bottom housing member 13 and rests inside of an annular rib 16 extending upwardly from the oval-shaped bottom portion 17 of housing member 13. Bottom housing member 13 includes an elongated dome-shaped battery housing 19 for containing a battery 21 which supplies the electrical power to circuit board 15, and in particular the logic control circuit 14 formed on circuit board 15. A circular rib 23 is formed on bottom housing member 13 and surrounds a circular opening 25 in which is located a piezo audible alarm 27 which is electrically connected to the circuit board 15 at solder terminals 18 (FIG. 5). Battery 21 is retained within battery housing 19 by a battery door 29 secured to bottom housing member 13 by a fastener 30.

Figure 4:
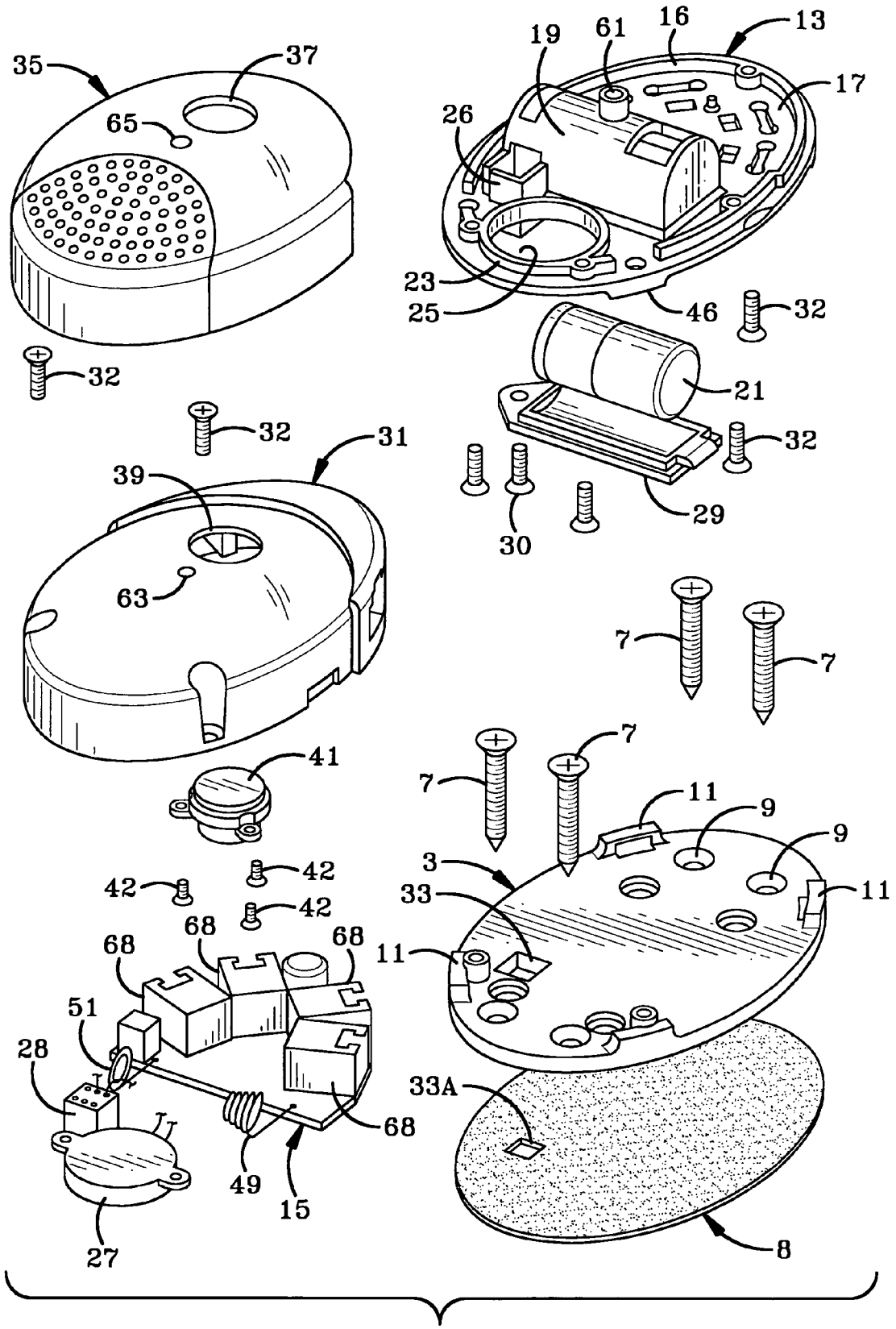
FIG. 4 is an exploded perspective view of the alarm module.
Figures 4A, 9:
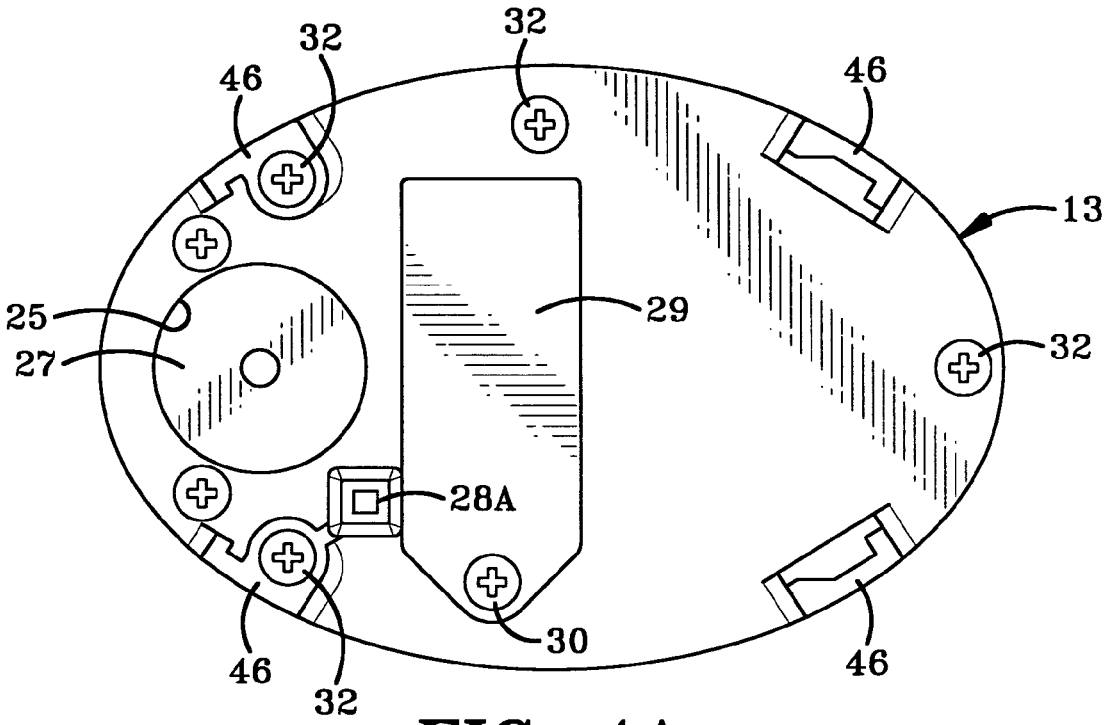
FIG. 4A is a bottom plan view of the underside surface of the bottom housing member.
FIG. 9 is a list explaining the abbreviations and terms used in the flow chart of FIG. 8.
Figure 5:
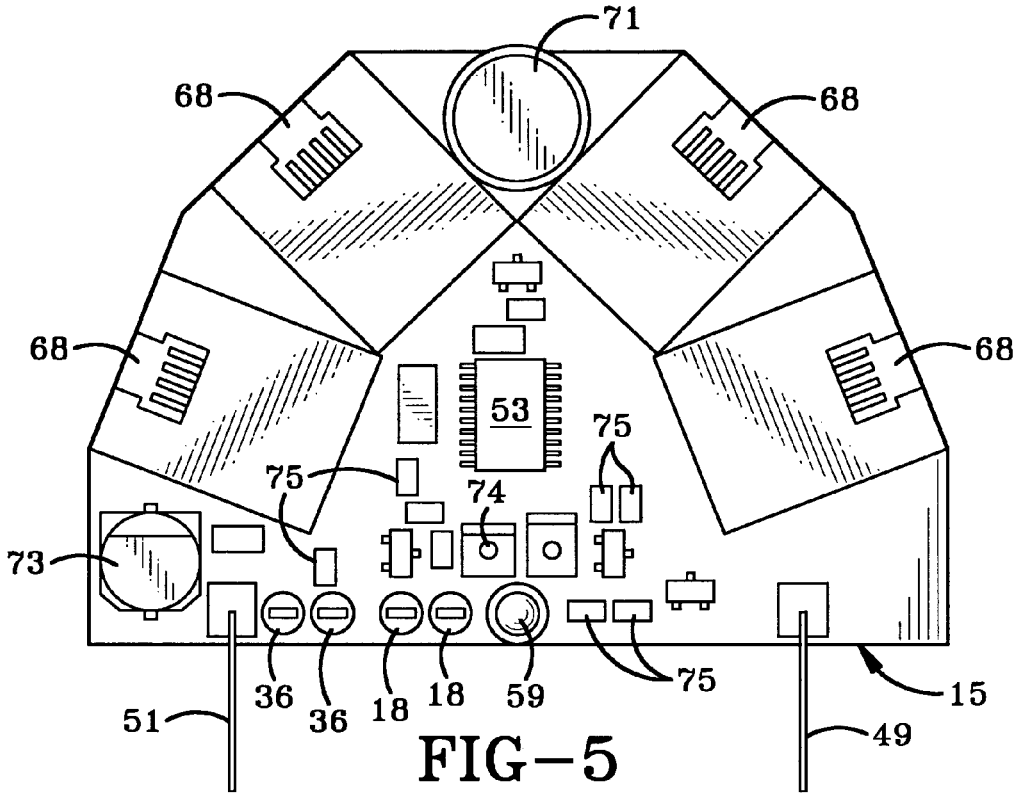
FIG. 5 is a diagrammatic top plan view of the printed circuit board assembly of the alarm module.
Figure 7:
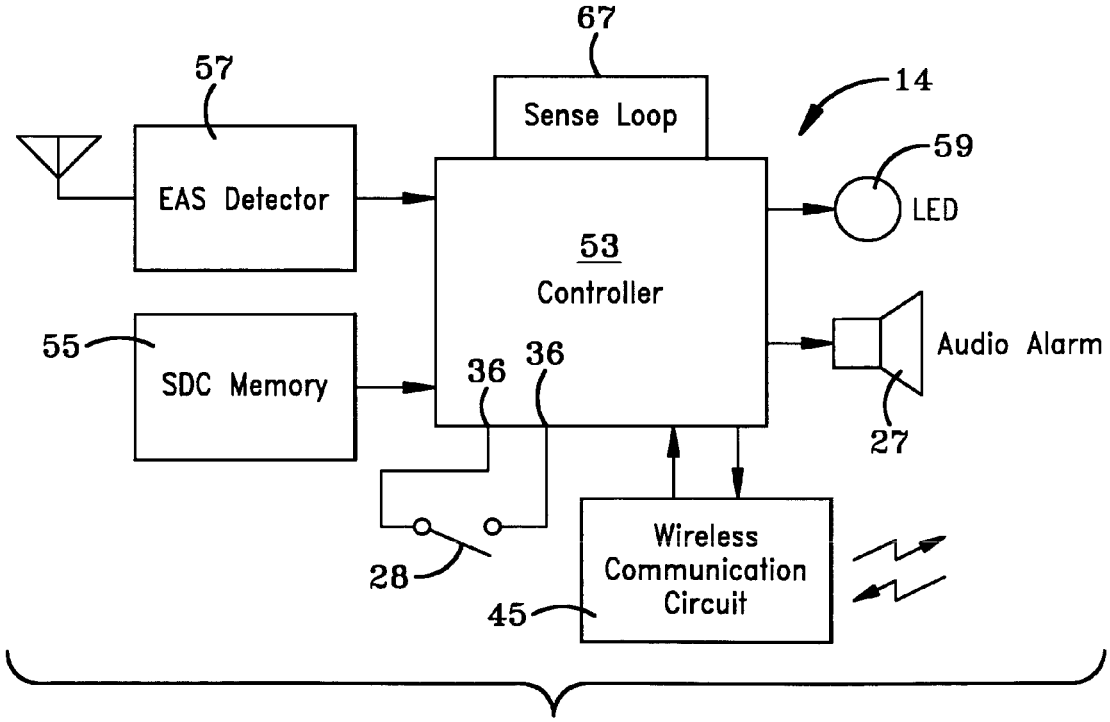
FIG. 7 is a block diagram of the control logic circuit of the alarm module.

A contact switch 28, FIGS. 4 and 4A, is mounted within a rectangular-shaped partition 26 formed on bottom housing member 13 adjacent battery housing 19 and has a plunger 28A which extends through openings 33 and 33A formed in base 3 and pressure sensitive adhesive pad 8, respectively, and into contact with support 5. Switch 28 is electrically connected to the logic control circuit at solder points 36 as shown in FIGS. 5 and 7. Switch 28 will be actuated if bottom housing member 13 is removed from base 3 and will sound alarm 27 unless alarm module has been disarmed as discussed below.

A top housing member, indicated generally at 31 (FIGS. 3 and 4), is mounted on and secured to bottom housing member 13 by a plurality of attachment screws 32. Top housing member 31 is a dome-shaped member and forms a hollow interior 34 with bottom housing member 13, which provides a space for receiving and protecting circuit board 15 and the various components formed thereon. A top housing cover plate 35 is mounted on top of top housing member 31 and secured thereto by a snap fit engagement. Cover plate 35 includes a circular-shaped smart key receiving port 37 which aligns with a complementary-shaped circular opening 39 formed in top housing member 31. A light pipe 41 is mounted by screws 42 within opening 39 to enhance the infrared (IR) transmission of communication waves between a smart key 43 (FIG. 10) and a wireless communication circuit 45 which is formed on circuit board 15, providing the wireless communication between the smart key and the control logic circuit of alarm module 1.

Figure 3:
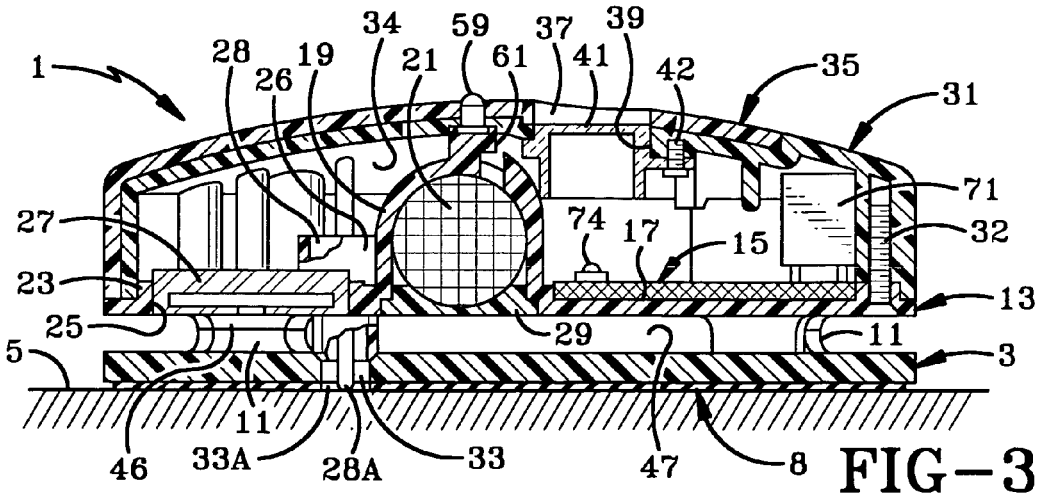
FIG. 3 is a sectional view taken on line 3-3, FIG. 1.

As shown in FIG. 3, posts 11 of base 3 align with similarly shaped posts 46 found on the bottom surface of housing member 13 and forms a space 47 between the top surface of base 3 and the bottom surface of bottom housing member 13. Space 47 enables piezo audible alarm 27 which is mounted in opening 25 of bottom housing member 13 and communicates directly with space 47 to discharge its sound waves when actuated directly into space 47 enhancing the dB level of the alarm in order to better alert store personnel of the actuation of the audible alarm than a lower dB level that occurs with prior alarm modules wherein the audible alarm is concealed within the housing and the housing mounted directly on a supporting surface without the intervening sound space 47 being provided therein.

Battery 21 when mounted within housing 19 will extend between and contact negative and positive terminals 49 and 51 mounted on and extending outwardly from circuit board 15. The logic control circuit 14 is formed on printed circuit board 15 and is shown in block diagram in FIG. 7. Circuit 14 includes a main controller 53 which preferably is a microprocessor, as well as wireless communication circuit 45, which in the preferred embodiment operates on infrared (IR), but could be radio frequency (RF) or other type of wireless communication without affecting the concept of the invention. A security disarm code (SDC) memory 55 is connected to controller 53, as well as an EAS tag detector 57.

An LED 59 is connected to control logic circuit 14 and is located in a mounting boss 61 (FIGS. 3 and 4) formed on top of battery housing 19 and extends through aligned holes 63 and 65 formed in top housing member 31 and top housing cover 13, respectively, so as to be visible by anyone viewing alarm module 1. Control logic circuit 14 further includes one or more sense loops 67 which are in communication with and extend from a plurality of jack ports 68, four of which are shown on printed circuit board 15. Each sense loop, which preferably is an electrical conductor or a fiber optic conductor, extends through attachment cable 69 which extends from alarm module 1 to an item of merchandise 70 to be protected by the security system of the present invention, as shown diagrammatically in FIG. 10. A switch (not shown) usually will connect the sense loop to merchandise 70 to sound alarm 27 if merchandise 70 is illegally removed from cable 69.

Figure 6:
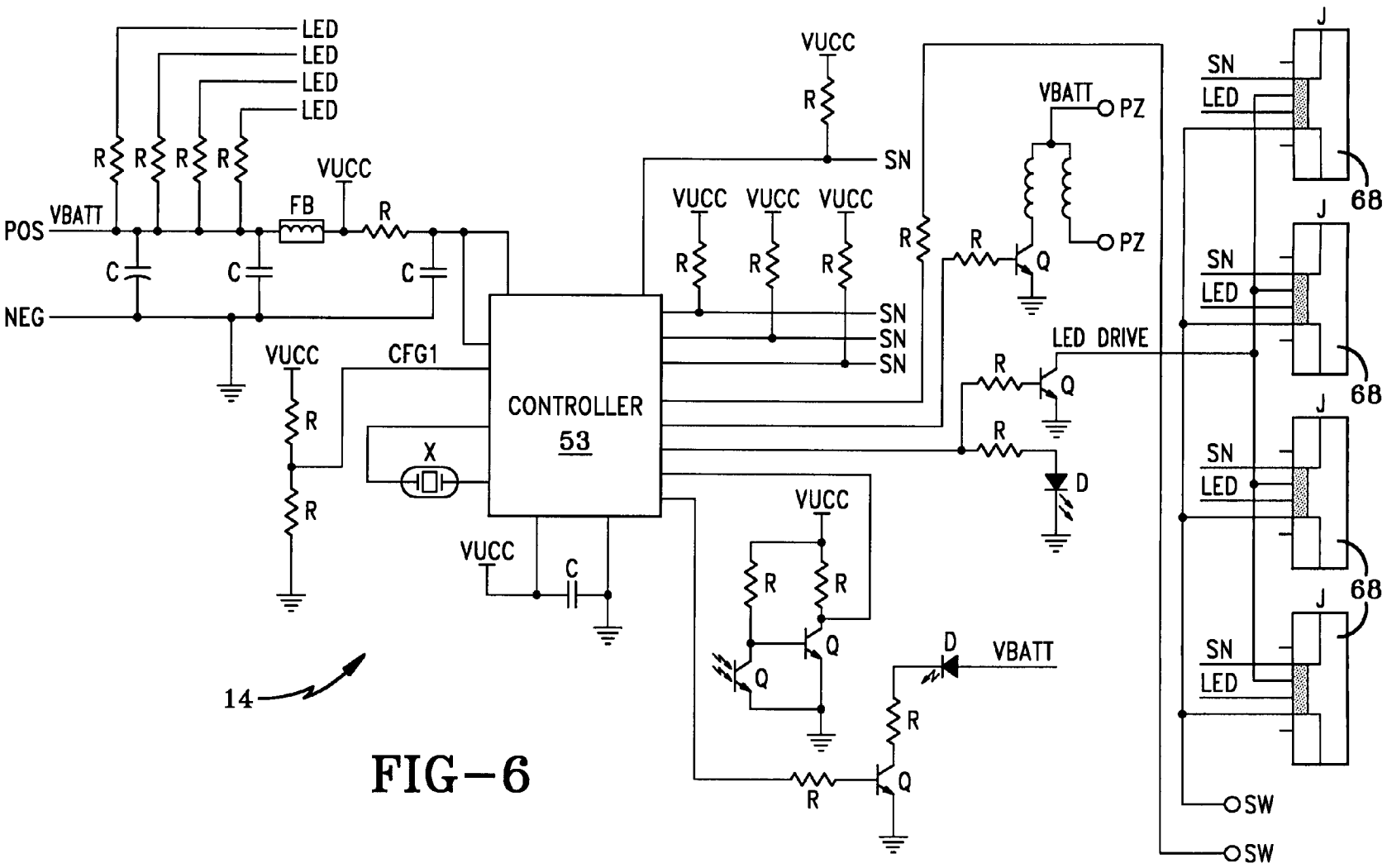
FIG. 6 is a schematic wiring diagram of the printed circuit board of FIG. 5.

Printed circuit board 15 is shown diagrammatically in FIG. 5 and includes as its main components four attachment ports or jacks 68 for receiving the end couplers of attachment cable 69, each of which preferably contains an internal electrical sense loop 67, which loops are electrically and operatively connected to the control logic circuit 14. Controller 53 is mounted on circuit board 15, as well as a step up transformer 71, a capacitor 73, LED 59, LED diode 74, sundry resistors and capacitors 75. It is readily understood that the particular circuit components shown in FIGS. 5 and 6 can vary without effecting the concept of the invention and that one skilled in the art can determine the type and values of these components and various arrangements thereof to achieve the results described above.

Figure 10:
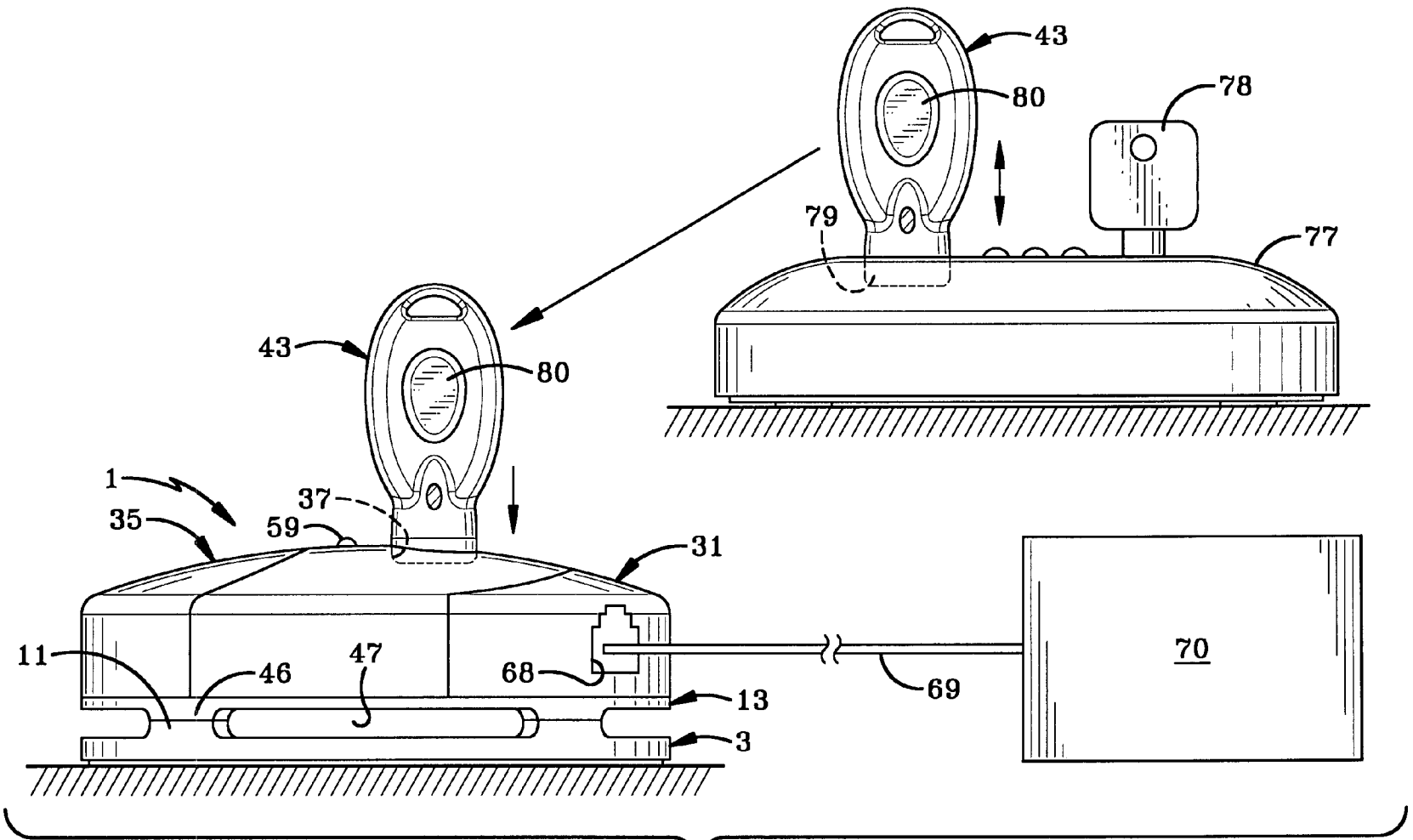
FIG. 10 is a diagrammatic view of one type of security system using the alarm module of the present invention.

FIG. 10 shows a security system of the type in which alarm module 1 will be utilized. The programmable smart key 43, such as shown and described in a copending patent application filed concurrently herewith entitled Programmable Key For A Security System For Protecting Merchandise is programmed with the SDC from a programming station indicated generally at 77. Station 77 preferably is the type shown and described in a copending patent application filed currently herewith entitled Programming Station For A Security System For Protectinq Merchandise, which as described therein is protected by a mechanical key 78. After turning key 78 and inserting smart key 43 into a programming port 79 formed in station 77, smart key button 80 is depressed, which due to the particular circuitry present in programming station 77 and through a wireless communication system, will program a unique SDC into key 43. This SDC is randomly generated by the logic control circuit of unprogrammed station 77 the first time unprogrammed key 43 is placed in communication therewith. This unique SDC remains in the programming station throughout its life and is a single unique code that is always used in the particular retail establishment having station 77. Thus, no other store even using a similar type of security system and programming station such as station 77, will have the same SDC which is programmed into its security keys. This prevents a key from one store even if programmed, from being used in another store, even with a similar type of security system and alarm module as discussed above.

After key 43 has been programmed with the SDC, it is then taken to the individual alarm modules 1 as shown in FIG. 10 and placed into key receiving port 37. Upon actuation of control button 80, key 43 will program the SDC into alarm module 1, and in particular into SDC memory 55 through the wireless communication circuit 45. This SDC is then stored permanently in the control logic circuit of alarm module 1. The module will give visual and audio feedback through LED 59 and alarm 27 to indicate that the programming was successful. This programming of the SDC into module 1 together with the closing of switch 28 and the attaching of at least one sensor to product 70 will arm the alarm module. The alarm module also provides a flashing indication of LED 59 when attachment cable 69 is attached to an item of merchandise 70 with the electrical connection being provided by sense loop 67. Should a thief violate the integrity of sense loop 67, such as illegally removing merchandise 70 from cable 69 or removing the sense loop or the cable from alarm module 1 or interfering directly with the control logic circuit contained therein or removing security device 1 from support surface 5 and actuating plunger switch 28, will cause alarm 27 to sound a preset chirping together with a flashing of LED. This chirping as discussed above, will be exceedingly loud due to the sound emitting space 47 being provided between base 3 and bottom housing member 13. The alarm module will remain alarmed until a clerk attaches a correctly coded key 43 to alarm module 1. The logic control circuit will verify that the proper disarming key is attached through the wireless communication system and disarm the unit. An audio indication is then given by alarm 27 by a different type of chirping sound indicating that the unit is now disarmed.

Should an improperly coded key 43, for example, a key obtained from another store, be used with alarm unit 1, the unit will continue in its current mode, armed or alarming. This arrangement ensures that only smart keys 43 which are programmed by the proper programming station 77 with the unique SDC for that particular retail establishment can be used with the alarm modules previously programmed with the unique SDC, again usable only at the single retail establishment. This prevents smart keys 43 from another store being used which may have been obtained illegally from the second store.

As discussed in greater detail in the above-referenced patent application covering the smart key, it preferably includes an internal timer, which after a preset time period, for example 96 hours, will invalidate the SDC previously programmed therein. This requires the key to be reactivated at the proper programming station 77 for subsequent use for disarming alarm module 1. Thus a smart key 43 illegally obtained can only be used for a short period of time and only in the store containing the correct programming station for illegally disarming alarm module 1.

In accordance with another feature of the invention, alarm module 1, and in particular the control logic circuit 14 thereof, will contain a lifetime timer which has been previously configured at the time of manufacture to have a specific life, for example three or five years. The lifetime timer will start at the first receipt of the SDC from programming station 77, and after the expiration of the preset time period, will completely shut down the logic control circuit making the alarm module 1 inoperative for further programming of an SDC therein until the battery is replaced. The time period has been previously calculated based upon the battery used therein to ensure that the alarm module will have sufficient battery power to be operable.

In addition to this lifetime timer, an additional counter is provided which keeps track of the cumulative alarming time that alarm 27 is actuated, since actuation of the alarm will cause drain of the internal battery. The amount of time that the alarm 27 is operated will be recorded by the counter and, through controller 53, will automatically adjust the lifetime timer of the alarm module decreasing it according to a specific formula, to ensure that the alarm module has sufficient battery charge to be operable. For example, should the counter record 15 minutes of alarm time, it will reduce the end of life timer time period a specific amount, for example 6 months or 1 year etc. to ensure that the battery always has sufficient charge to be operable.

Furthermore, shortly before the lifetime timer reaches its end-of-life time out period, it will actuate a near end-of-life signal, for example five days prior to the end-of-life time out, such as flashing LED 59 with a specific flashing pattern and provide audible alarm 27 with a specific type of beep pattern, for example once every ten seconds. This near end-of-life signal will then alert the store personnel that the alarm module will be permanently deactivated within a relatively short period of time enabling the alarm unit to be replaced or the battery contained therein replaced with a fully charged battery.

The overall security system shown diagrammatically in FIG. 10 in which alarm module 1 preferably will be utilized, can be of the type shown and described in further detail in a copending application filed concurrently herewith entitled, Security System And Method For Protecting Merchandise. The contents of this pending patent application as well as the patent applications covering the smart key 43 and programming station 77 are incorporated herein by reference.

Figure 8:
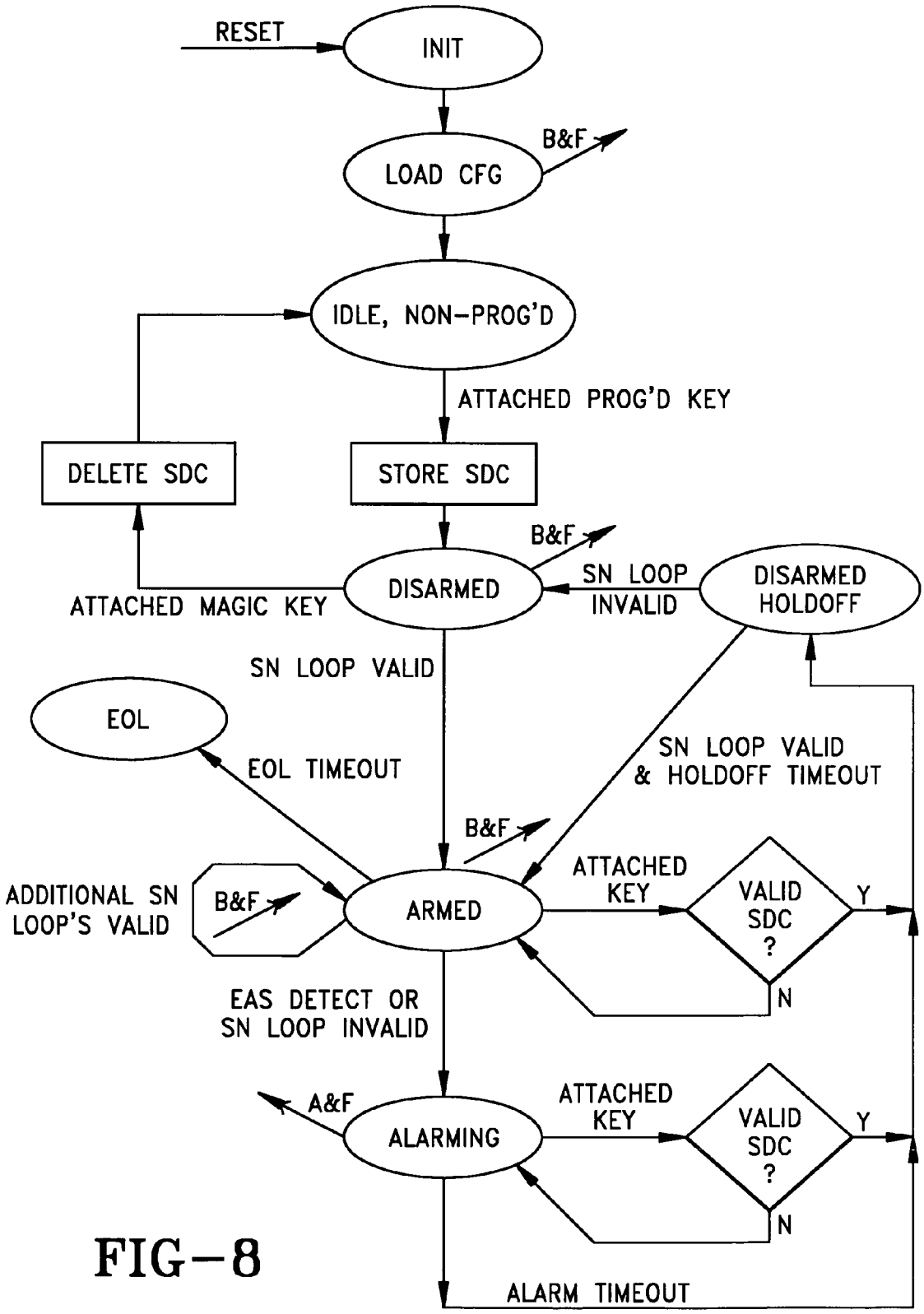
FIG. 8 is the flow chart of the control logic circuit for the alarm module.

FIG. 8 is a flow chart showing the various steps that the control logic circuit 14 of alarm module 1 follows when a smart key 43 is used with the control module and whether the end-of-life (EOL) time period had been reached, as well as the state of the sense loops attached thereto.

Although the above description refers to the security code being a disarm code, it is understood that the code can activate and control other functions and features of the security device such as unlocking the device from the product, shutting off an alarm etc. without departing from the concept of the invention. Likewise, the various components of the logic circuit and resulting flow charts can easily be modified by one skilled in the art to achieve the same results. Also, the security code can be preset in the programming station at the factory or chosen by the customer, and if desired, be changed later by the customer, also without affecting the concept of the invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security alarm module for attaching to an item of merchandise comprising:

a) a housing;

b) a logic control circuit including:

1) a central controller, 2) a communications interface for communicating with a key containing a security code, and 3) a memory circuit for storing the security code;

c) an attachment device for attaching the alarm module to an item of merchandise;

d) a sense loop operatively communicating with the attachment device for sensing when the integrity of the attachment device is compromised; and e) an audio alarm located within the housing for actuation when the sense loop senses that the integrity of the attachment device is compromised.

2. The alarm module defined in claim 1 wherein the housing includes a base, a bottom housing member mounted on the base, a top housing member mounted on the bottom housing member and a cover mounted on the top housing member.

3. The alarm module defined in claim 2 wherein the logic control circuit is formed on a printed circuit board; and in which said circuit board is mounted on the bottom housing member.

4. The alarm module defined in claim 2 wherein a light pipe is mounted on the top housing member adjacent a key receiving port.

5. The alarm module defined in claim 2 wherein the base is spaced from the bottom housing member forming a sound emitting space therebetween; in which the audio alarm is mounted in an opening formed in the bottom housing member; and in which the audio alarm communicates directly with the sound emitting space.

6. The alarm module defined in claim 1 including a power supply, wherein the logic control circuit is operatively connected to the power supply.

7. The alarm module defined in claim 6 wherein the power supply is a battery mounted between a pair of terminals mounted on a printed circuit board.

8. The alarm module defined in claim 1 wherein the logic control circuit includes a visual indicator indicating the status of the alarm module.

9. The alarm module defined in claim 8 wherein the visual indicator is an LED.

10. The alarm module defined in claim 1 wherein the audio alarm is a piezoelectric alarm operatively connected to a printed circuit board.

11. The alarm module defined in claim 1 including a plurality of terminal jacks operatively connected to the logic control circuit for connection of one or more attachment devices and sense loops to the alarm module.

12. The alarm module defined in claim 1 wherein the logic control circuit includes an end-of-life timer which automatically inactivates the alarm module after a predetermined time period programmed into the logic control circuit.

13. The alarm module defined in claim 12 wherein the logic control circuit further includes a counter which counts the amount of time the audio alarm is actuated; and in which said amount of time reduces the predetermined time period of the end-of-life timer.

14. The alarm module defined in claim 1 wherein a key port is formed in the housing for receiving the key therein, said port being proximate a wireless communication circuit; and in which said wireless communication circuit operates on infrared (IR) or radio frequency (RF) wavelengths.

15. A security system for protecting an object comprising:

an alarm module for attachment to the object, said alarm module containing a controller, a wireless communication circuit, an audio alarm and a security code memory;

a key programmed with a security code for programming the security code into the security code memory of the alarm module when the key is placed in proximity thereto;

a programming station for programming the security code into the key;

a wireless communication system in the key for programming the security code into the alarm module and for comparing the security code of the key to the security code stored in the security code memory of the alarm module; and at least one sense loop connecting the alarm module and the object;

wherein the audio alarm in the alarm module is actuated when the integrity of the sense loop is compromised.

16. The security system defined in claim 15 wherein the wireless communication system of the key and the wireless communication circuit of the alarm module uses infrared (IR) or radio frequency (RF) wavelengths for programming the alarm module with the security code from the key.

17. The security system defined in claim 15 wherein the controller provides visual and audio feedback that the alarm module has been programmed with the security code from the key.

18. The security system defined in claim 15 wherein the alarm module includes a visual indicator indicating that an attachment device has connected the alarm module to the object.

19. The security system defined in claim 15 wherein the controller is a microprocessor and the security code is a code for disarming the alarm module.

20. The security system defined in claim 15 including an end-of-life timer and a counter; in which the timer inactivates the alarm module after a certain time period; and in which the counter reduces the time period in the end-of-life timer if the audio alarm is activated.

* * * * *